United States Patent [19]

Pinson et al.

[11] 4,168,813

[45] Sep. 25, 1979

[54] GUIDANCE SYSTEM FOR MISSILES

[75] Inventors: George T. Pinson; James A. Daniel, both of Huntsville, Ala.

[73] Assignee: The Boeing Company, Seattle, Wash.

[21] Appl. No.: 731,312

[22] Filed: Oct. 12, 1976

[51] Int. Cl.[2] ..... F42B 15/02; F42B 15/10; F42B 15/00

[52] U.S. Cl. ..... 244/3.16; 244/3.15

[58] Field of Search ..... 244/3.16

[56] References Cited

U.S. PATENT DOCUMENTS

| | | | |
|---|---|---|---|
| 2,963,973 | 12/1960 | Estey | 244/3.16 |
| 3,729,152 | 3/1973 | Stephenson | 244/3.16 |
| 3,982,714 | 9/1976 | Kuhn | 244/3.16 |
| 4,039,246 | 8/1977 | Voigt | 244/3.16 |

*Primary Examiner*—Samuel W. Engle

*Assistant Examiner*—Thomas H. Webb

*Attorney, Agent, or Firm*—Thomas H. Murray

[57] ABSTRACT

A missile guidance system is provided in which a sensor is pivotally mounted on the missile in a gimbal system having two degrees of freedom. The sensor is controlled during flight in such a manner that the axis of the sensor is aligned in a direction determined by the acceleration of the missile, and the sensor locates the target and determines the angle between the direction of the sensor axis and the direction of the target. Guidance information is derived from this angle for directing the missile toward the target. Compensation for gravity may be provided by means of a spring suitably arranged in the gimbal system. The sensor system may be either active or passive and may be responsive to any desired type of signal from the target.

12 Claims, 7 Drawing Figures

GUIDANCE SYSTEM FOR MISSILES

BACKGROUND OF THE INVENTION

The present invention relates to guidance systems for missiles, and more particularly to a terminal homing guidance system.

Both command and homing guidance systems have been used for guidance of small missiles such as anti-tank missiles, for example. Command guidance schemes provide some type of command to the missile from a ground launcher position to direct the missile to a line-of-sight flight to the target. The commands are transmitted to the missile by a radio-frequency link, a laser link or by wire, the necessary calculations being performed at the launcher by a ground-based computer with associated sensors, or by the operator. Such a system has many disadvantages since the ground equipment is heavy and complex, wire-guidance systems are limited in range, and operator-command systems have limited performance capability as well as requiring the operator to be exposed during the flight of the missile.

Homing guidance systems utilize an on-board sensor carried on the missile to detect the target, and the command calculations are performed on board the missile. Proportional navigation or some type of pursuit guidance is usually used in these systems. Proportional navigation requires the use of inertial stabilization by means of gyros to maintain the inertial line-of-sight orientation for reference purposes to direct the missile. This type of system, therefore, involves the use of relatively sophisticated hardware and computers, and results in systems which are large and heavy as well as expensive. Where high accuracy requirements are involved and cost is not a primary factor, however, high performance systems of this type have frequently been used. Pursuit guidance systems which control only attitude and/or velocity direction are inexpensive since they avoid the requirement for inertial stabilization. These systems, however, have relatively low performance capability and can be used only for stationary targets or targets which maneuver at quite low speed.

SUMMARY OF THE INVENTION

The present invention provides a new type of missile guidance system capable of high performance with low weight and low production costs, and which is not affected by such dispersion forces as winds and misalignments and does not require an inertial reference system. The new system is readily adaptable for either continuously accelerating missiles or missiles having constant or nearly constant velocity.

In accordance with one embodiment of the invention, a sensor for detecting the target is carried on the missile and is pivotally mounted in a gimbal system having two degrees of freedom. The sensor is unbalanced in a manner which causes it to move pivotally and align its axis with the direction of forward acceleration of the missile, the two-degree-of-freedom mounting permitting such movement. The sensor may be of any suitable type capable of sensing a signal from the target to determine the direction of the target from the missile. The sensor thus determines the angle between the direction of acceleration of the missile and the direction of the target. This information is processed on board the missile and generates guidance commands to the missile control surfaces determined by the angle between the direction of acceleration and the direction of the target and the rate of change of this angle, as well as the rate of the inner gimbal itself. In this way, a system is provided which is very simple but which is capable of high performance and does not require any inertial reference, or sophisticated computer equipment on the missile. The sensor can be of any desired type, either active or passive, to respond to any suitable signals received from the target such as infrared or radio-frequency radiation, a reflected laser beam, or other types of signals. The system is inherently free of the effects of dispersion forces such as winds, thrust misalignment, and various offsets and misalignments in the missile itself since the sensor aligns itself with the resultant acceleration vector. The effects of gravity can be compensated for, if desired, by the addition of a suitable force to the unbalanced sensor mounting which can readily be done by means of a spring. A lightweight and inexpensive guidance system of high accuracy is thus provided.

In another embodiment of the invention suitable for missiles having substantially constant velocity, the sensor is similarly mounted pivotally in the missile and is aligned relative to the axis of the missile in response to the lateral acceleration. Suitable means, either passive or active, are provided with a desired transfer function for positioning the axis of the sensor in accordance with the lateral acceleration. The sensor determines the angle between its axis and the direction of the target and guidance commands for the missile are generated from this information.

BRIEF DESCRIPTION OF THE DRAWINGS

The invention will be more fully understood from the following detailed description, taken in connection with the accompanying drawings, in which.

DESCRIPTION OF PREFERRED EMBODIMENTS

Figure 1:
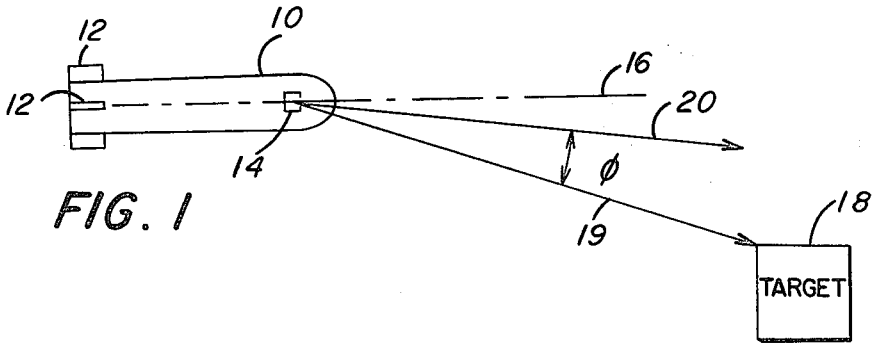
FIG. 1 is a diagram illustrating the principle of the invention.

The principle of the new guidance system is shown diagrammatically in FIG. 1 as applied to a continuously accelerating missile. As there shown, a missile 10 has control surfaces 12 and may be provided with any suitable propulsion system that continuously accelerates the missile and which has not been shown as it is not a part of the invention. A sensing and control means 14 is carried on board the missile 10 and generates signals for actuating the control surfaces 12 to control the direction of flight of the missile. The sensing means 14 is mounted on the axis 16 of the missile and is adapted to sense the presence of a target 18 and to determine the position of the line-of-sight 19 to the target. As described below, the sensing means is adapted to align itself with the forward acceleration vector 20 of the missile to determine the angle between the acceleration vector and the direction of the target 18. The sensing and guidance control system 14 thus determines this angle and generates signals which actuate the control surfaces 12 to direct the flight of the missile 10 in a manner to reduce the angle $\phi$ so that the missile 10 is directed to the target 18.

Figure 2:
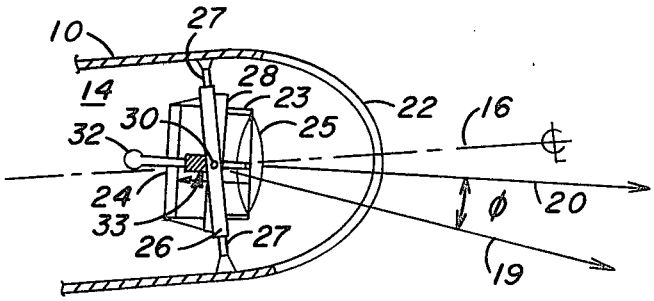
FIG. 2 is a somewhat diagrammatic view of the forward portion of a missile illustrating the mounting of the sensor system.

The mounting of the sensor system on the missile is shown somewhat diagrammatically in FIG. 2. As there shown, the sensor 14 is pivotally supported in the forward portion of the missile 10 behind a suitable window 22 which is provided at the front of the missile. This may be a window of any suitable type transparent to the particular type of signal or radiation to which the sensor responds. The sensor itself may be contained in a cylindrical housing or boresight 23 and may be of any suitable type such as an array of detectors or radiation sensitive devices disposed in a detector assembly 24. An optical system 25 may also be supported in the housing 23 to collimate or focus the incoming signals on the detector assembly 24.

The sensor assembly 14 is supported on the axis 16 of the missile in a manner permitting pivotal movement in two directions. As shown in FIG. 2, this is achieved by suspending the sensor 14 in a gimbal system having two degrees of freedom. The boresight or housing 23 is suspended in an outer gimbal ring 26 mounted on pivots 27 on the missile structure for pivotal movement about a vertical or yaw axis. The housing 23 is supported in a second or inner gimbal ring 28 pivoted in the outer ring 26 at points 30 to pivot in the pitch plane about a horizontal axis at right angles to the pivotal axis of the outer ring 26. This suspension system for the sensor thus has two degrees of freedom and the sensor assembly 14 is free to pivot in two directions.

In accordance with the present invention, the sensor assembly 14 is unbalanced about its pivotal axes. In this embodiment, the assembly includes an unbalanced mass 32 disposed substantially on the longitudinal axis of the sensor, which is the axis of the boresight 23. The mass 32 extends in the aft direction from the pivotal mounting and is of sufficient mass and spaced far enough from the pivot to control the alignment of the sensor 14 with respect to the axis of the missile. In flight, the acceleration of the missile is the result of the various forces acting on the missile including thrust, aerodynamic forces, control forces, and roll and misalignment forces. The resultant of these forces determines the acceleration vector 20 of the missile, and the unbalanced mass 32 behind the gimbal pivot point causes the axis of the sensor 14 to be aligned with the acceleration vector, as shown in FIG. 2. The detector assembly 24 is sensitive to signals received directly from the target and establishes the line-of-sight 19 to the target. The angle $\phi$ between the missile acceleration vector 20 and the line-of-sight 19 is thus directly determined by the sensor assembly. A two axis rate sensor or gyro 23 is preferably provided on the inner gimbal to provide a rate signal to be combined with the sensor signal.

Dispersion forces such as winds, thrust or other misalignments in the missile itself, and effects of offsets of the center of gravity are included in the sensor measurements and are thus inherently compensated for, so that such effects do not significantly affect the accuracy of the system. Close manufacturing tolerances and expensive quality control procedures are thus made unnecessary and the cost of manufacture can be kept low. Many missile control systems use roll of the missile to average out the effects of thrust and center of gravity misalignments, but since these effects are inherently compensated for in the present system and do not adversely affect the accuracy, the missile is not required to roll. The sensor 14, therefore, is required to measure the angles between the acceleration vector and the direction of the target in pitch and yaw only.

Figure 3:
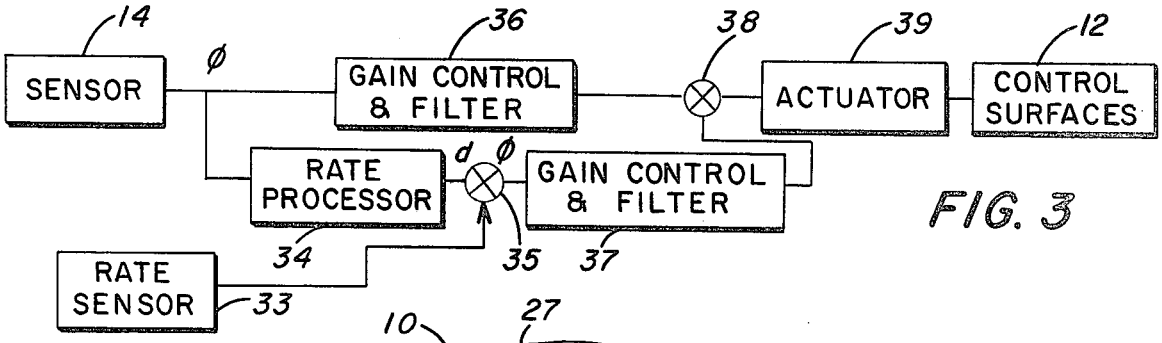
FIG. 3 is a simplified block diagram of the guidance system.

A simplified representation of the control scheme is shown diagrammatically in FIG. 3 for one channel, that is, either the pitch channel or the yaw channel, it being understood that a similar system is provided for the other channel. As discussed above, the sensor 14 measures the angle $\phi$ between the acceleration vector and the line-of-sight to the target. A rate processor or differentiator 34 is provided which, in effect, differentiates the signal produced by the sensor 14 to generate a signal representing the rate of change of the angle. Signals from the sensor 33 and the output of rate processor 34 are summed in a summing network 35. The angle and rate signals are passed through gain control and filter networks 36 and 37, respectively, and are combined or summed in a summing network 38. The resulting signal is applied to an actuator 39 which adjusts the positions of the control surfaces 12 to control the direction of flight of the missile 10. Similar control command signals are applied from the other channel to the actuator 39, or to a separate actuator, and the control surfaces 12 are thus moved to control the direction of flight of the missile in a manner to reduce the angle $\phi$ and thus direct the missile toward the target.

Figure 4:
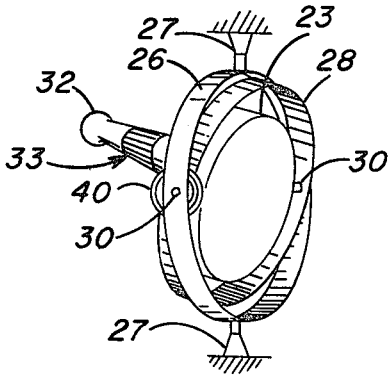
FIG. 4 is a somewhat diagrammatic view of the sensor mounting showing a preferred form of gravity compensation.

In many instances, the system as so far described provides sufficient accuracy. An important aspect of the invention, however, is the ability to incorporate gravity compensation as a part of the guidance system in a simple manner. The unbalanced mass system as so far described does not measure the acceleration due to gravity which may introduce errors. During flight of the missile, the forces acting on the sensor 14 are the resultant acceleration forces discussed above together with any forces such as spring and damping forces generated in the system itself. Compensation for gravity, therefore, is easily accomplished by introducing a force acting on the unbalanced mass 32 and proportional to the acceleration due to gravity. This implies a spring-type force such that a vertical 1 g acceleration is required to balance the gravitational force in horizontal flight. Such a spring force can be readily incorporated in the gimbal suspension. FIG. 4 is a somewhat diagrammatic side view of the gimbal system and shows the use of a torsion spring 40 acting on the inner gimbal ring 28 so as to affect the sensor 14 in the pitch plane of the missile. Such a spring provides a spring force proportional to the gravity force acting on the missile, and thus provides the desired compensation which is included in the command signals to the control surfaces. Gravity compensation is thus easily provided in a manner which does not require any calculation or added complication in the control or signal-processing portion of the system.

This spring arrangement, or equivalent arrangements for introducing a spring force, provides complete inherent gravity compensation in horizontal flight of the missile. If the flight path is not horizontal, some error in gravity compensation may be introduced. For non-horizontal flight, the required compensation depends on the missile attitude, and more specifically the required compensation factor is a function of the cosine of the angle which the missile longitudinal axis makes with a normal to the gravity vector, that is, the angle between the missile axis and the horizontal. If this angle is not greater than about 25°, the error introduced by neglecting this factor amounts to less than 10% and in most cases is negligible. If the missile attitude is expected to involve angles from the horizontal greater than 25°, some correction should be introduced into the control system to compensate for this error.

Figure 5:
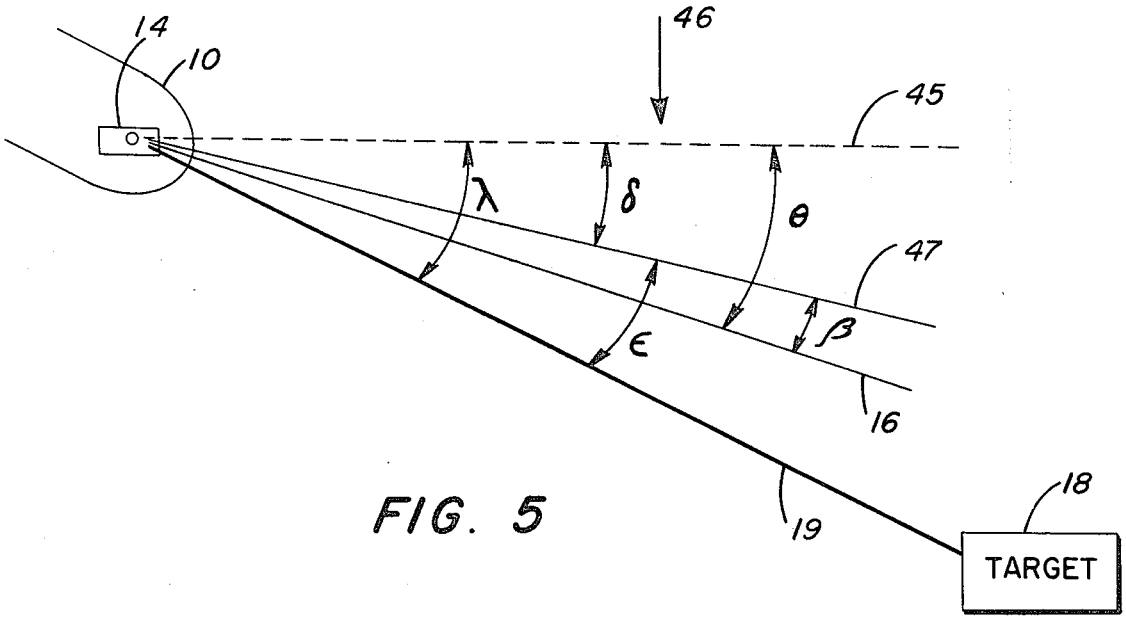
FIG. 5 is a diagram illustrating the principles of a second embodiment of the invention.

FIG. 5 shows diagrammatically the operation of another embodiment of the invention for missiles which have constant velocity, or nearly constant velocity, so that the forward acceleration is near zero. In FIG. 5, the position of the axis 16 of the missile is shown with respect to an arbitrary reference line 45. The line-of-sight 19 to the target 18 is shown as having an angle $\lambda$ with the reference line 45. In this embodiment of the invention, there is no forward acceleration vector but for guidance purposes, the missile has a lateral acceleration represented by the vector 46. The rate of this acceleration determines the angular position of the missile, since the turning rate of the missile is a function of the acceleration. The resulting instantaneous position of the missile axis 16 is represented by the angle $\theta$. As in the previous embodiment, the position of the axis of the sensor 14 with respect to the missile is determined by the acceleration to which the missile is subjected. As more fully described below, the sensor is mounted on the missile, and its position is controlled in such a way that the axis 47 of the sensor is oriented at an angle $\beta$ with respect to the missile axis which is related to the lateral acceleration, and so that the sensor axis legs the missile axis with respect to the direction of acceleration. The position of the sensor axis therefore is defined by the angle $\delta=\theta-\beta$. The angle from the sensor axis 47 to the line-of-sight 19 to the target is then $\lambda-\delta$. The sensor 14, as previously described, senses the target and determines the angle $\epsilon$ between the sensor axis and and the line-of-sight to the target. Since $\epsilon=\lambda-\epsilon$, this information can be used as before to generate guidance commands for controlling the flight of the missile to reduce the angles $\lambda$ and $\epsilon$.

Figure 6:
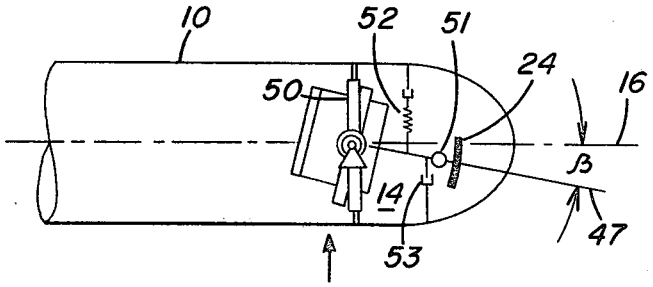
FIG. 6 is a diagrammatic view showing a passive system for controlling the alignment of the sensor system in the second embodiment of the invention.

A passive mounting and control system for positioning the sensor axis relative to the missile 10 is shown in FIG. 6. As there shown, somewhat diagrammatically, the sensor 14 may be generally similar to that previously described in connection with FIG. 2. That is, the sensor includes a detector assembly 24 pivotally mounted on the axis 16 of the missile by a two-degree-of-freedom gimbal system 50 which may be like that previously described including gravity compensation if desired. The sensor system is unbalanced about the pivotal support, as before, by an unbalanced mass 51 but in this embodiment the mass 51 and detector 24 extend forward of the missile from the pivotal support. When the missile is subjected to a lateral acceleration in the direction of the arrow in FIG. 6, therefore, the sensor system aligns its axis 47 at an angle $\beta$ lagging the missile axis 16. The alignment of the sensor axis is controlled by a system of positive constraints which may be any suitable type. As shown, a system of springs 52 and dampers 53 may be provided to control the positioning of the sensor axis in response to lateral acceleration. The restraint system can readily be designed to have any desired transfer function, or to closely approximate the desired function, so that the angle $\beta$ has a predetermined relation to the lateral acceleration. This makes it possible to obtain high guidance performance in a relatively simple system.

Figure 7:
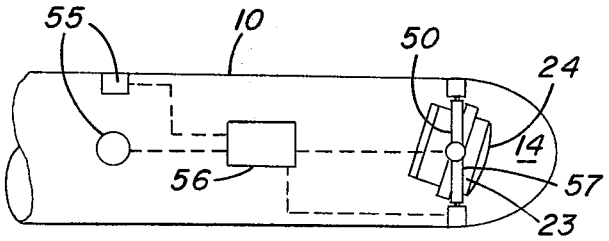
FIG. 7 is a similar diagrammatic view showing an active system for aligning the sensor system.

FIG. 7 shows an active system for positioning the sensor axis in response to lateral acceleration. In this system, the sensor 14 is again pivotally mounted on the missile axis in a two-degree-of-freedom gimbal system 50. The lateral acceleration components in pitch and yaw are sensed by suitably positioned accelerometers 55 and the signals thus obtained are supplied to a processor 56 on the missile which modifies the signals in accordance with the desired transfer function. The processor 56 supplies output signals to control positioners 57, which may be servomoters or other suitable devices, to move the gimbal rings and align the sensor axis at the desired angle to the missile axis. In this way the sensor axis is positioned in response to the lateral acceleration to have a predetermined angle with the missile axis as determined by the transfer function of the processor 56.

Thus, either passive or active systems may be used to align the sensor axis as shown in FIG. 5 in response to lateral acceleration. The passive system, such as that shown in FIG. 6, requires only relatively simple mechanical components and has relatively low cost. It can, however, only be designed for a particular missile and for a specific transfer function which, in many cases, can only be approximately although within close enough limits for satisfactory results. The active system of FIG. 7 can be developed for general application to any missile as it is only necessary to change the processor 56 to a different transfer function to adapt to a different missile. This system, therefore, is more versatile in application and also offers the possibility of programming the processor 56 to change or modify the transfer function during flight. In either system, however, the sensor axis is aligned in a predetermined manner in response to lateral acceleration. The sensor determines the angle between its axis and the line-of-sight to the target and this information is provided to a control system such as that of FIG. 3 which generates guidance commands for controlling the flight of the missile in the manner previously described.

Any desired type of sensor or sensing system 14 may be used in this guidance system to detect the target and determine the line-of-sight from the missile to the target. Such sensor systems may be either active systems which transmit a signal from the missile and respond to the reflected signal from the target, or passive systems which merely receive signals from the target. In either case, any type of signal may be used such as infrared or radio-frequency radiation, either emitted or reflected from the target, laser beams reflected from the target and originating either from a remote transmitter or from the missile itself, or any other known or suitable type of signal. Similarly, the sensing system may utilize any type of sensor which can respond to the signal used and determine the angle between the sensor axis and the direction of the target as described above.

It will now be apparent that a missile guidance system has been provided which is relatively simple and makes possible low-cost, lightweight guidance systems. The new system has many advantages since it is not adversely affected by such dispersion forces as winds and misalignments, and can include gravity compensation in a very simple manner. No inertial reference system is required and the on-board signal processing equipment can be relatively simple. The cost and complexity of the on-board hardware are thus greatly reduced compared to systems which rquire on-board inertial platforms and sophisticated computers.

We claim as our invention:

1. A guidance system for directing a missile to a target, said system including sensing means, pivotal mounting means whereby the sensing means is pivotally mounted on the missile in a manner to permit movement in two directions, said sensing means having an axis and including means for sensing the direction of the target from the missile, means responsive to acceleration of the missile for positioning the sensing means with its axis aligned in a direction determined by the acceleration, means for generating a signal representing the angle between the direction of the target and the axis of the sensing means, and means responsive to said signal for controlling the direction of flight of the missile to reduce said angle.

2. A guidance system as defined in claim 1 including means for determining the angle between the direction of the target and the axis of the sensing means, means for generating signals proportional to said angle and to the rate of change of said angle, and means responsive to said signals for controlling the flight of the missile.

3. A guidance system as defined in claim 1 in which said sensing means is mounted in a gimbal system having two degrees of freedom.

4. A guidance system as defined in claim 3 in which said sensing means includes means for compensating for gravitational acceleration forces.

5. A guidance system as defined in claim 4 in which said compensating means comprises spring means adapted to apply a force to the sensing means proportional to the gravitational acceleration.

6. A guidance system as defined in claim 1 in which said means responsive to acceleration positions the axis of the sensing means in alignment with the direction of forward acceleration of the missile.

7. A guidance system as defined in claim 6 in which said sensing means is mechanically unbalanced with respect to said pivotal mounting to cause it to be positioned with the axis of the sensing means aligned with the diirection of forward acceleration of the missile.

8. A guidance system as defined in claim 7 in which the sensing means includes an unbalanced mass disposed on the axis of the sensing means in a position aft of the pivotal mounting of the sensing means.

9. A guidance system as defined in claim 1 in which said means responsive to acceleration positions the axis of the sensing means at a predetermined angle relative to the axis of the missile in response to lateral acceleration of the missile.

10. A guidance system as defined in claim 9 in which said sensing means is mounted in a gimbal system having two degrees of freedom.

11. A guidance system as defined in claim 10 in which the sensing means includes an unbalanced mass disposed on the axis of the sensing means in a position forward of the pivotal mounting of the sensing means, and passive restraint means attached to the sensing means to cause it to move about the pivotal mounting in a predetermined manner in response to lateral acceleration of the missile.

12. A guidance system as defined in claim 10 including accelerometer means on the missile for sensing lateral acceleration of the missile and means controlled by said accelerometer means for positioning said sensing means to align the axis of the sensing means in a predetermined manner in response to lateral acceleration of the missile.

* * * * *